US006994211B2

(12) United States Patent
Cho

(10) Patent No.: US 6,994,211 B2
(45) Date of Patent: Feb. 7, 2006

(54) CAP DEVICE FOR MIXING DIFFERENT KINDS OF MATERIALS SEPARATELY CONTAINED THEREIN AND IN BOTTLE

(76) Inventor: Young Kook Cho, 3090 E. 50th St., Vernon, CA (US) 90052

( * ) Notice: Subject to any disclaimer, the term of this patent is extended or adjusted under 35 U.S.C. 154(b) by 75 days.

(21) Appl. No.: 10/684,036

(22) Filed: Oct. 14, 2003

(65) Prior Publication Data

US 2004/0200741 A1 Oct. 14, 2004

(30) Foreign Application Priority Data

Apr. 12, 2003 (KR) ..... 10-2003-0023241

(51) Int. Cl.
*B65D 25/08* (2006.01)

(52) U.S. Cl. ..... 206/221; 206/219; 215/DIG. 8

(58) Field of Classification Search ..... 206/219, 206/221, 222; 215/DIG. 8; 222/83, 129
See application file for complete search history.

(56) References Cited

U.S. PATENT DOCUMENTS 4,315,570 A * 2/1982 Silver et al. ..... 206/221
4,513,861 A * 4/1985 Baram ..... 206/219
5,863,126 A * 1/1999 Guild ..... 366/130
6,533,113 B2 * 3/2003 Moscovitz ..... 206/222
6,705,491 B1 * 3/2004 Lizerbram et al. ..... 222/145.1
6,763,939 B2 * 7/2004 Alticosalian ..... 206/222
2004/0007481 A1 * 1/2004 Kiser, Jr. ..... 206/219
2004/0154937 A1 * 8/2004 Cho ..... 206/219

* cited by examiner

*Primary Examiner*—David T. Fidei
(74) *Attorney, Agent, or Firm*—Jerry H. Noh

(57) ABSTRACT

A cap device for bottles, in which a valve means is stably placed at a desired position in a neck of the bottle, without being undesirably displaced, and which allows an additive and a material to be completely separately stored in the cap device and the bottle, respectively, such that the additive is not undesirably added to the bottled material. The cap device has a cap body tightened to an externally threaded mouth of a bottle, with a funnel part integrally formed in the cap body to discharge an additive from the cap body into the bottle through a lower end thereof. A cap cover is assembled with the cap body to cover an open upper end of the cap body while defining a cavity inside both the cap body and the cap cover to contain the additive in the cavity. The cap device also has a valve means for opening or closing the lower end of the funnel part of the cap body in accordance with a rotating action of the cap body relative to the externally threaded mouth of the bottle. The valve means comprises a valve member having a conical valve part to be brought into close contact with or spaced apart from the lower end of the funnel part of the cap body, thus closing or opening the lower end of the funnel part. A plurality of radial ribs extend outward from an external surface of the conical valve part in radial directions. A ring is integrated with outside ends of the radial ribs so as to be supported on an inner surface of a neck of the bottle.

4 Claims, 3 Drawing Sheets

CAP DEVICE FOR MIXING DIFFERENT KINDS OF MATERIALS SEPARATELY CONTAINED THEREIN AND IN BOTTLE

BACKGROUND OF THE INVENTION

1. Field of the Invention

The present invention relates, in general, to caps for bottles which contain a variety of materials, such as drinks, liquid medicines or liquid chemicals, therein and, more particularly, to a cap device for such bottles, which is capable of mixing an additive contained therein with a material contained in a bottle to prepare a mixture in accordance with a simple rotating action of the cap device relative to the bottle, performed by a user, thus allowing the user to easily prepare the mixture just before taking or using the mixture.

2. Description of the Related Art

In the prior art, most conventional disposable bottles circulated and sold in markets each contain therein only a single kind of material, such as a drink, a liquid medicine or a liquid chemical, and are closed by caps at mouths thereof. When a user wants to add an additive to the material contained in such a capped bottle so as to prepare a mixture prior to taking or using the mixture, the user must add the additive from a separate container to the bottled material after removing a cap from the bottle. Therefore, it is necessary for manufacturers of the additives and the bottled materials to separately contain such additives and materials in separate containers and bottles prior to marketing them, thus undesirably wasting natural resources due to the production of the separate containers and capped bottles. In addition, the adding of the additive from the separate container to the bottled material to mix them after removing the cap from the bottle is inconvenient to the user in that the user is forced to separately purchase and handle the additive container and the bottle.

Furthermore, it is extremely difficult for most users to add a precise amount of the additive from the separate container to the material contained in the bottle, and so that the user roughly measures the amount of the additive to be added to the bottled material. Therefore, in the case of mixing of an additive with a bottled drink to produce a mixed beverage, the rough measurement of the amount of the additive may result in change in taste and quality of the mixed beverage. In the case of mixing of an additive with a bottled liquid medicine or a bottled liquid chemical to produce a mixed medicine or a mixed chemical, the rough measurement of the amount of the additive may result in incomplete dissolution of effective ingredients of the additive in the medicine or the chemical and a failure of accomplishment of desired medical or chemical effects of the mixed medicine or the mixed chemical.

Of course, when mixtures are prepared by manufacturers at factories and are marketed in a bottled state, in place of allowing users to mix additives with bottled materials to prepare mixtures just before taking or using the mixtures, it is possible to avoid the above-described problems experienced in the mixing of the additives with the bottled materials performed by the users. However, the mixtures which are prepared by the manufacturers and marketed in the bottled state are problematic in that the effects of ingredients of the bottled mixtures may be gradually degraded with progressive passage of time, in addition to change in colors of the mixtures. Furthermore, the bottled mixtures may generate floating matters and deposit therein with gradual passage of time.

In an effort to overcome the above-described problems, the inventor of the present invention proposed a cap device for bottles, which is capable of mixing an additive contained therein with a material contained in a bottle to prepare a mixture, in Korean Patent Application No. 10-2002-31470. In the above cap device, a plurality of radial ribs are provided at a valve means, and are supported at outside ends thereof on an inner surface of a neck of the bottle. However, since the outside ends of the above radial ribs are formed as free ends, the radial ribs may be easily bent or deformed. Therefore, the valve means may be easily displaced in the neck of the bottle.

Furthermore, it is necessary to completely separately store the additive in the cap device and the material in the bottle, such that the additive is not undesirably added to the bottled material. Therefore, a sealing means for allowing the additive and the material to be completely separately stored in the cap device and the bottle is required.

That is, it is necessary to accomplish an airtight or watertight sealing effect at a junction between a part of the cap device containing the additive therein and another part of the cap device which communicates with the bottle containing the material therein, thus preventing an undesired mixing of the additive with the bottled material and thereby preventing any physical or chemical change in the additive and the bottled material due to the undesired mixing of them. When the airtight or watertight sealing effect at the above junction is accomplished, the operational effect of the cap device is enhanced.

SUMMARY OF THE INVENTION

Accordingly, the present invention has been made keeping in mind the above problems occurring in the prior art, and an object of the present invention is to provide a cap device for bottles, which is capable of mixing an additive contained therein with a bottled material to prepare a mixture in accordance with a simple rotating action of the cap device relative to a bottle, performed by a user, thereby allowing the user to easily prepare the mixture just before taking or using the mixture.

Another object of the present invention is to provide a cap device for bottles, in which a valve means is stably placed at a desired position in a neck of the bottle, without being undesirably displaced.

A further object of the present invention is to provide a cap device for bottles, which allows the additive and the material to be completely and separately stored in the cap device and the bottle, respectively, such that the additive is not undesirably added to the bottled material.

In order to accomplish the above objects, the present invention provides a cap device for bottles having a cap body tightened to an externally threaded mouth of a bottle, with a funnel part integrally formed in the cap body to discharge an additive from the cap body into the bottle through a lower end thereof. A cap cover is assembled with the cap body to cover an open upper end of the cap body while defining a cavity inside both the cap body and the cap cover to contain the additive in the cavity. The cap device further has a valve means for opening or closing the lower end of the funnel part of the cap body in accordance with a rotating action of the cap body relative to the externally threaded mouth of the bottle. The valve means comprises a valve member having: a conical valve part to be brought into close contact with or spaced apart from the lower end of the funnel part of the cap body, thus closing or opening the lower end of the funnel part; a plurality of radial ribs extending outward from an external surface of the conical valve part in radial directions; and a ring integrated with outside ends of the radial ribs so as to be supported on an inner surface of a neck of the bottle.

The cap device further comprises: a sealing means provided at a junction between the valve member and the lower end of the funnel part of the cap body, thus accomplishing a sealing effect at the junction.

The sealing means comprises: a plugging shank of a conical valve body extending upward from a valve holder of the valve part, with an external thread formed around the plugging shank such that the external thread of the plugging shank has the same pitch as an internal thread of the lower end of the funnel part; and an engaging part formed on an internal surface of the lower end of the funnel part so as to engage with the external thread of the plugging shank.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
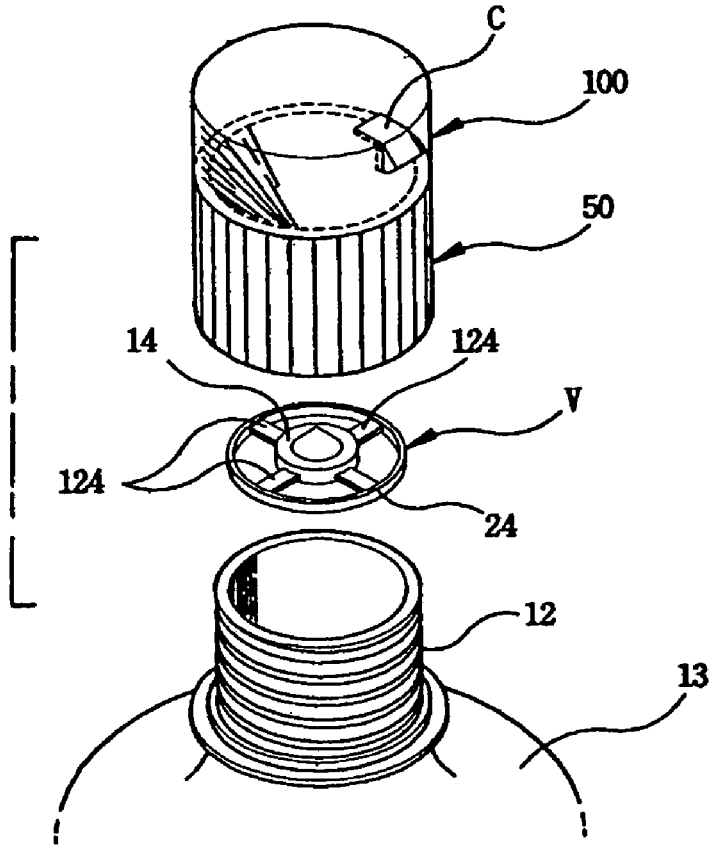
FIG. 1 is an exploded perspective view showing a construction of a cap device, according to a first embodiment of the present invention.
Figure 2:
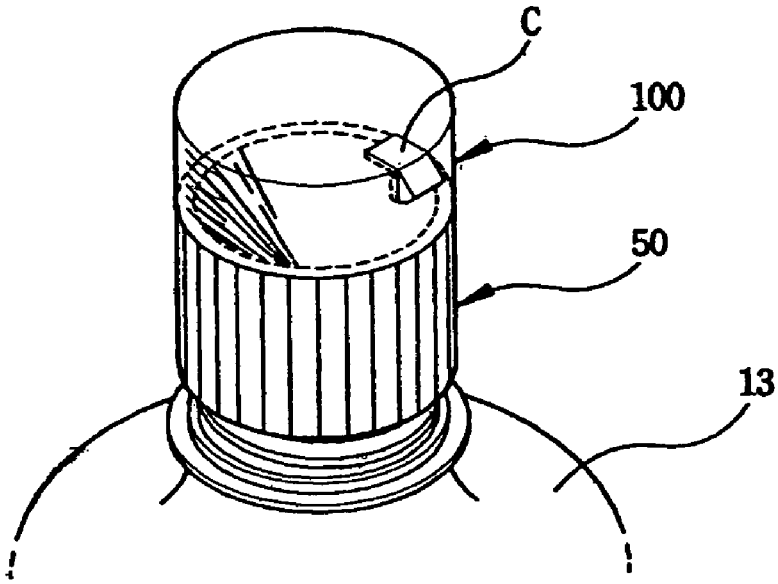
FIG. 2 is a perspective view of the cap device of FIG. 1, when the assembled cap device is tightened to a mouth of a bottle.

Reference should now be made to the drawings, in which the same reference numerals are used throughout the different drawings to designate the same or similar components.

FIGS. 1 through 3*b* are views of a cap device for bottles according to a first embodiment of the present invention. As shown in the drawings, the cap device according to the present invention comprises a cap body 50, and a cap cover 100 assembled with the cap body 50 to define a cavity therein for containing an additive. The cap device also has a valve means to allow the cavity defined by the cap body 50 and the cap cover 100 to selectively communicate with an interior of a bottle 13.

In a detailed description, the cap body 50 is tightened to an externally threaded mouth 12 of the bottle 13, with a funnel part 52 integrally formed in the cap body 50 to discharge the additive into the bottle 13 through a lower end thereof.

The cap cover 100 is assembled with the cap body 50 to cover an open upper end of the cap body 50 while defining the cavity inside both the cap body 50 and the cap cover 100 to contain the additive in the cavity.

In the first embodiment, the valve means comprises a valve member "V" having a conical valve part 14 to be brought into close contact with or spaced apart from the lower end of the funnel part 52 of the cap body 50, which acts as a valve seat. The conical valve part 14 of the valve member "V" thus closes or opens the lower end of the funnel part 52 in accordance with the rotating action of the cap body 50 relative to the externally threaded mouth 12 of the bottle 13. A plurality of radial ribs 124 extend outward from an external surface of the conical valve part 14 in radial directions such that outside ends of the radial ribs 124 are supported on the inner surface of a neck of the bottle 13. In order to allow the outside ends of the radial ribs 124 to be stably supported on the inner surface of the neck of the bottle 13, a circular ring 24 having a predetermined thickness integrally surrounds the outside ends of the radial ribs 124.

Figure 3A:
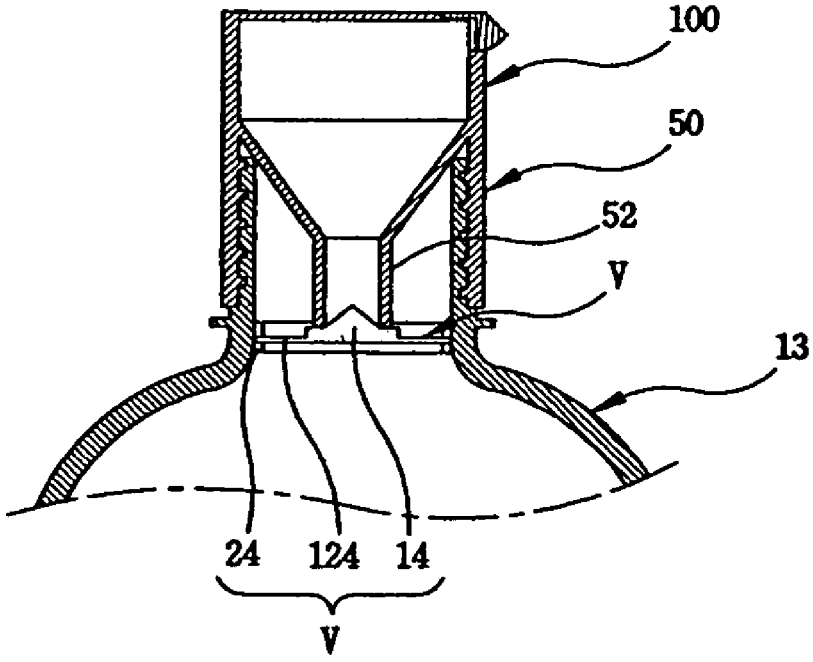
FIGS. 3*a* and 3*b* are sectional views showing an operation of the cap device of FIG. 2.
Figure 3B:
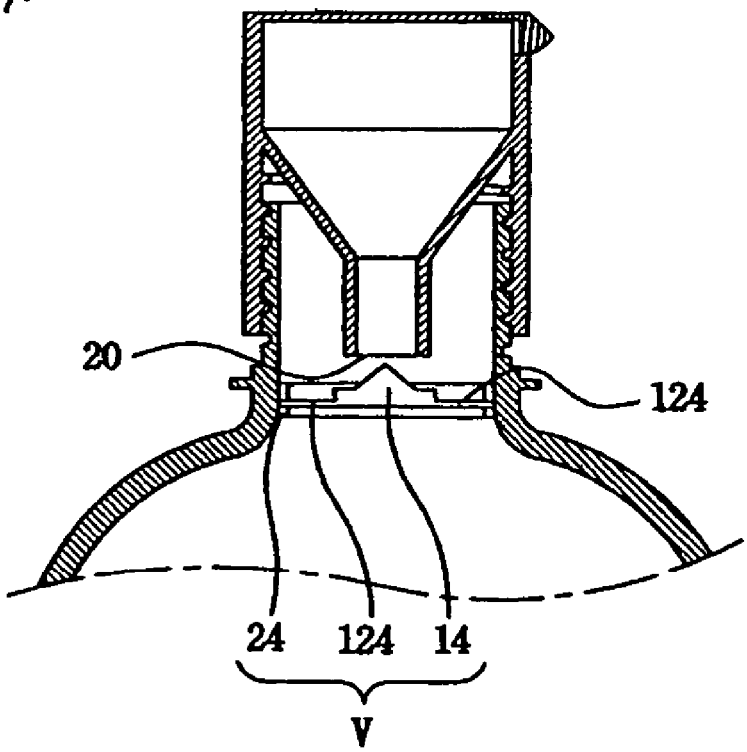

When the cap body 50 of the cap device having the above-described construction is rotated to move up relative to the externally threaded mouth 12 of the bottle 13, the valve means opens the lower end of the funnel part 52 of the cap body 50. Therefore, the cavity defined by the cap body 50 and the cap cover 100 of the cap device communicates with the interior of the bottle 13, as shown in FIGS. 3*a* and 3*b*. The additive is thus discharged from the cavity defined by the cap body 50 and the cap cover 100 into the bottle 13 to be mixed with a material contained in the bottle 13 to produce a mixture.

In the cap device of FIGS. 1 through 3*b*, a vacuum pressure may act on the surface of the additive contained in the cavity of the cap device when the cap cover 100 is completely closed. In such a case, the additive cannot smoothly flow from the cavity of the cap device into the bottle 13, even when the cavity communicates with the interior of the bottle 13 by an operation of the valve means. In order to allow the additive to smoothly flow from the cavity into the bottle 13 in response to the communication of the cavity with the interior of the bottle 13, a small vent hole provided with a valve cock "C" to open or close the vent hole is formed at a top surface of the cap cover 100. When the valve cock "C" opens the vent hole, atmospheric air is introduced into the cavity of the cap device through the vent hole, thereby preventing any vacuum pressure from acting on the surface of the additive in the cavity. The additive thus smoothly flows from the cavity of the cap device into the bottle 13, so that the additive is easily added to the material in the bottle 13 to produce a desired mixture.

Figure 4A:
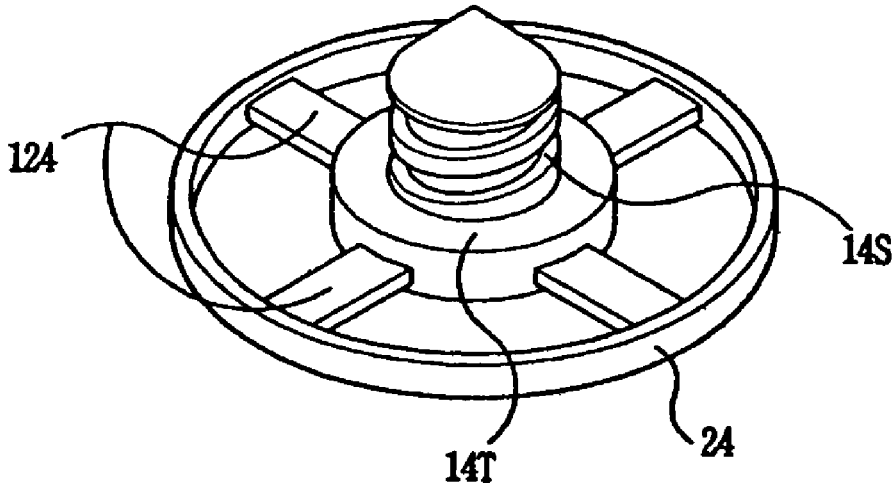
FIG. 4*a* is a perspective view of a valve means of the cap device, according to a second embodiment of the present invention.
Figure 4B:
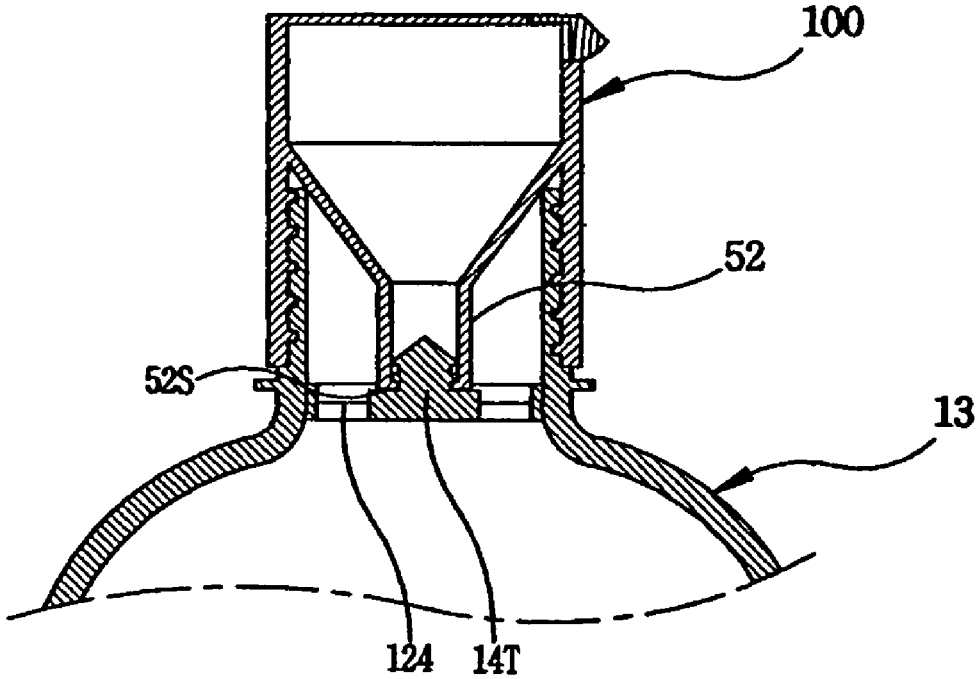
FIG. 4*b* is a sectional view showing an operation of the valve means of FIG. 4*a*, which is installed in the cap device tightened to a mouth of a bottle.

FIGS. 4*a* and 4*b* are views of an alternative valve means of the cap device, according to a second embodiment of the present invention. As shown in the drawings, a sealing means is provided at a junction between the valve member "V" and the lower end of the funnel part 52 of the cap body 50, thus accomplishing an airtight or watertight sealing effect at the junction. The sealing means is provided at the conical valve part 14 of the valve member "V". That is, the sealing means comprises a plugging shank 14S of a conical valve body extending upward from a valve holder 14T of the conical valve part 14. An external thread is formed around the plugging shank 14S, such that the external thread of the plugging shank 14S has the same pitch as an internal thread of the lower end of the funnel part 52 of the cap body 50. In order to engage with the external thread of the plugging shank 14S, the lower end of the funnel part 52 is provided with an engaging part 52S on an internal surface thereof. Due to the sealing means, the desired sealing effect at the junction between the valve member "V" and the funnel part 52 is accomplished.

When the cap body 50 of the cap device is rotated to move up relative to the externally threaded mouth 12 of the bottle 13, the lower end of the funnel part 52 is rotated to move in the same direction relative to the plugging shank 14S. In such a case, the internal thread 52S of the funnel part 52 moves upward along the external thread of the plugging shank 14S to open the lower end of the funnel part 52. Due to the screw-type engagement of the valve member "V" with the lower end of the funnel part 52, it is possible to accomplish the airtight or watertight sealing effect at the junction between the valve member "V" and the lower end of the funnel part 52.

As described above, the present invention provides a cap device for bottles, which is capable of mixing an additive contained therein with a bottled material to prepare a mixture in accordance with a simple rotating action of the cap device relative to a bottle, performed by a user, thereby allowing the user to easily prepare the mixture just before taking or using the mixture. The cap device of the present invention allows the additive and the bottled material to be maintained in pure states without being mixed together before a user adds the additive to the bottled material by rotating the cap device relative to a mouth of the bottle. The cap device is thus free from physical or chemical problems of degradation in the effects of ingredients, change in colors, and a generation of floating matters and deposit experienced in conventional bottled mixtures marketed in a bottled state.

In addition, the cap device of the present invention allows the additive and the bottled material to be stored in separate states, and allows the user to mix a precise amount of the additive with the bottled material to prepare the mixture. Thus, the cap device does not force the user to separately purchase and handle an additive container and the bottle, and is convenient to the user. The cap device is also free from excessive consumption of natural resources due to the separate production of the containers for additives and the capped bottles. Since the cap device allows the user to mix the precise amount of the additive with the bottled material to prepare the mixture, it is possible to prevent change in taste and quality of the mixture in the case of preparing a mixed beverage through the mixing, and to prevent incomplete dissolution of effective ingredients of the additive in the bottled material or a failure of accomplishment of desired medical or chemical effects of the mixture in the case of preparing a mixed medicine or a mixed chemical through the mixing.

Furthermore, the radial ribs of the valve means of the cap device are integrated with each other by a circular ring at the outside ends thereof, so that the valve means is stably placed at a desired position in a neck of the bottle, without being undesirably displaced.

The cap device also accomplishes an airtight or watertight sealing effect at a junction between a part of the cap device containing the additive therein and another part of the cap device which communicates with the bottle containing the material therein, thus preventing an undesired mixing of the additive with the bottled material and thereby preventing any physical or chemical change in the additive and the bottled material due to the undesired mixing of them. The operational effect of the cap device is thus enhanced.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cap device for a bottle, said cap device comprising:

a cap body tightened to an externally threaded mouth of said bottle;

a funnel part integrally having an open lower end formed in the cap body;

a cap cover assembled with the cap body to cover an open upper end of the cap body while defining a cavity inside both the cap body and the cap cover to contain an additive in said cavity;

a conical valve part for opening and closing the lower end of the funnel part with a rotating action of the cap body relative to the externally threaded mouth of the bottle;

a plurality of radial ribs extending outward from an external surface of the conical valve part in radial directions;

a ring integrated with outside ends of the radial ribs so as to be supported on an inner surface of a neck of the bottle;

a plugging shank extending upward from a valve holder of the conical valve part;

internal threading formed on the lower end of the funnel part; and, an external threading formed around the plugging shank such that the external threading of the plugging shank has the same pitch as said internal threading of the lower end of the funnel part.

2. The cap device for a bottle as described in claim 1 further comprising an engaging part formed on an internal surface of the lower end of the funnel part so as to engage with the external threading of the plugging shank.

3. In a bottle having a neck and an externally threaded mouth, said bottle comprising:

a cap body tightened to said externally threaded mouth of said bottle;

a funnel part integrally having an open lower end formed in the cap body;

a cap cover assembled with the cap body to cover an open upper end of the cap body while defining a cavity inside both the cap body and the cap cover to contain an additive in said cavity;

a conical valve part for opening and closing the lower end of the funnel part;

a plurality of radial ribs extending outward from an external surface of the conical valve part in radial directions;

a ring integrated with outside ends of the radial ribs so as to be supported on an inner surface of said neck of the bottle;

a plugging shank extending upward from a valve holder of the conical valve part;

internal threading formed on the lower end of the funnel part; and, an external threading formed around the plugging shank such that the external threading of the plugging shank has the same pitch as said internal threading of the lower end of the funnel part.

4. The bottle as described in claim 3 further comprising an engaging part formed on an internal surface of the lower end of the funnel part so as to engage with the external threading of the plugging shank.

* * * * *